US005839265A

United States Patent [19]

Takagi et al.

[11] Patent Number: 5,839,265

[45] Date of Patent: Nov. 24, 1998

[54] COOLING DEVICE FOR FALSE TWISTING MACHINE

[75] Inventors: Jun Takagi; Misao Kashiwagi; Nobuhiro Koizumi, all of Otu, Japan

[73] Assignee: Toray Engineering Co., Ltd., Osaka, Japan

[21] Appl. No.: 865,099

[22] Filed: May 29, 1997

[30] Foreign Application Priority Data

May 30, 1996 [JP] Japan ..... 8-161131

[51] Int. Cl.[6] ..... D01H 7/46

[52] U.S. Cl. ..... 57/290; 28/279; 57/350; 57/351; 57/352

[58] Field of Search ..... 57/290, 352, 350, 57/351; 28/279

[56] References Cited

U.S. PATENT DOCUMENTS

| | | | |
|---|---|---|---|
| 5,359,845 | 11/1994 | Gabalda et al. | 57/290 |
| 5,372,004 | 12/1994 | Yamamoto et al. | 57/290 |
| 5,628,176 | 5/1997 | Morhenne et al. | 28/249 |
| 5,649,345 | 7/1997 | Menegatto | 28/249 |
| 5,666,797 | 9/1997 | Bruske et al. | 28/249 |
| 5,671,519 | 9/1997 | Naylor | 57/290 |

FOREIGN PATENT DOCUMENTS

| | | | |
|---|---|---|---|
| 58-191230 | 11/1983 | Japan . | |
| 1139838 | 6/1989 | Japan | 57/290 |
| 5-331727 | 12/1993 | Japan . | |
| 8-35136 | 2/1996 | Japan . | |
| 206579 | 5/1993 | Taiwan . | |
| 207249 | 6/1993 | Taiwan . | |

OTHER PUBLICATIONS

Translation of The Decision of the National Bureau of Standards dated Jan. 20, 1998.

*Primary Examiner*—William Stryjewski
*Attorney, Agent, or Firm*—Finnegan, Henderson, Farabow, Garrett & Dunner, L.L.P.

[57] ABSTRACT

A cooling device for a false twisting machine having a fixed wall member 16 and movable wall members 18*a* and 18*b* which have faced side surfaces between which yarn treatment passageways 19*a* and 19*b* are formed. The facing side surfaces are formed with yarn contacting portions 16*a*1 and 16*b*1 and 18*a*-1 and 18*b*-1, which are spaced along the direction of the running of the yarn in the yarn treatment passageways. The arrangement of the yarn contacting portions are such that contact with the yarn occurs alternately between the fixed wall member 16 and movable wall members 18*a* and 18*b*. A sucking duct 14 is opened to the yarn treatment passageways 19*a* and 19*b* to generate flows of fluid transverse to the running direction of the yarn in the passageways 19*a* and 19*b*.

10 Claims, 12 Drawing Sheets

COOLING DEVICE FOR FALSE TWISTING MACHINE

BACKGROUND OF THE INVENTION

1. Field of the Invention

The present invention relates generally to a false twisting machine, and, more particularly to a cooling device for a false twisting machine such as a draw-false twisting machine.

2. Background of the Invention

Known in the prior art is a false twisting machine provided with a false twisting device for imparting a false twist to a yarn taken out from a package, a heating device which is arranged upstream from the false twisting device and is for canceling an inner stress in the twist along the yarn as imparted by the false twisting device, a cooling device for a positive cooling of the yarn for a fixation of the false twist in the yarn, and a taking-up device for winding the bulky yarn after fixation of the false twist.

A draw false twisting machine is also known, which is additionally provided with a drawing device which is for executing a drawing operation of a predetermined drawing ratio simultaneously with or prior to the false twisting followed by fixation of the twist in the false twisting and the heating devices.

In the false twisting machine as above mentioned, it is well known that a suitable false twisting condition represented, for example, by a predetermined yarn taking up speed, exists, where a stable production is realized. An increase of the yarn speed above that for executing the stable condition causes a balanced condition to be lost between a tension in the yarn and a degree of a twist to the yarn at the false twisting zone, which causes a so-called a surging phenomenon to be generated, by which the yarn is subjected to an oscillation, resulting in an occurrence of a breakage or a loop in a single filament or uneven twist of the yarn.

In order to prevent an occurrence of such a surging phenomenon, an increase in a tension at the twisting zone is possible, which result in an increased number of filament breakage and a reduced elongation of the yarn after the completion of the false twisting, which are likely to be a cause of a disturbance during an execution of a subsequent process such as a knitting or wearing, thereby reducing a yield.

Furthermore, in the cooling device of a reduced length in the prior art, the high speed processing of the yarn causes the cooling time to be shortened, thereby preventing the yarn from being completely cooled to a temperature for obtaining a desired state of crimping. However, an increased length of the cooling device for obviate this problem causes the total machine size to be increased, which causes a workability to be worsened and a maintenance of the machine to be difficult. Furthermore, an increased frictional force and an increased resistance for a transmission of a twist are generated in the yarn in the cooling device, which results in a reduction in a degree of a crimping of the yarn as well as an amount of a residual elongation.

In order to combat the above problems, Japanese Unexamined Patent Publication (Kokai) No. 58-191230 proposes a yarn guide having a guide groove for a yarn for ejection, from its bottom, a flow of a gas for cooling the yarn. Japanese Unexamined Patent Publication (Kokai) No. 8-35136 discloses a cooling device of a divided type having an intermediate part, which is provided with a yarn supporting member and a member having a surface, which contacts with a yarn and defines holes for discharging or sucking refrigerant for cooling a yarn. Furthermore, in Japanese Unexamined Patent Publication (Kokai) No. 5-331727, a construction is disclosed wherein a plate is provided, the plate having a pair of grooved walls which are transversely spaced while a gap for a passage is formed between the members, yarn guide members are arranged at bottoms of the members so that they are spaced along the length of the yarn, the plate has an outer wall member connecting the grooved wall members at ends spaced from the yarn guides so that a pipe chamber is formed by the grooved wall members and the yarn guide members, and a suction means is arranged in the pipe chamber.

In the '230 patent, in order to cool the yarn, a fluid is injected from the bottom of a guide groove of a yarn guide member. As a result, heat of the yarn as well as spinning oil applied to the yarn during a preceding spinning process are emitted to an outside air conditioned atmosphere of a spinning room, which causes, on one hand, the condition for workers to be worsened and causes the air condition efficiency to be reduced.

In the '136 patent, an occurrence of a so-called surging can be suppressed due to the provision of the yarn support member as well as blowing or sucking of cooling air from the holes on the yarn contacting surface. However, the cooling is done by contacting the cooling air with the contacting plate to which a heat from the yarn is transmitted without a direct contact of the cooling air with the yarn. In such an indirect cooling, in case of a cooling of yarn of a thickness of, for example, 75 denier, the length of the contacting plate must at least be 1.2 m or longer in order to make the system to adapt to a high speed spinning more than 800 m/min. In order to reduce the length of the cooling device, a device is needed for feeding a refrigerant such as an alcohol, ether or water.

In '727 patent, a movement of the yarn is done, while contacting with the guides at the bottom portions of the grooved walls and the cooling of the yarn is done by a flow sucked by the sucking device connected to the pipe chamber between the yarn guides and the bottom portions of the grooved walls. As a result, at the bottom portion of the grooved wall and the yarn guide portion, a reduction is, for some extent, obtained as to an amount of attachment of excessive spinning oil applied to the yarn during the spinning as well as to scum. However, a complete elimination of the lubricant and the scum cannot be realized, and therefore, a complicated and tiresome work will frequently be necessary to clean the bottom portion of the grooved wall and the guide portion. Furthermore, a breakage of the yarn guide is likely due to an entanglement of broken filaments to the yarn guide and a cleaning operation.

SUMMARY OF THE INVENTION

An object of the present invention is to provide a cooling device for a false twisting machine, capable of overcoming the above difficulties in the prior art.

Another object of the present invention is to provide a cooling device for a false twisting machine of a reduced size, while maintaining a desired cooling capacity.

A further another object of the present invention is to provide a cooling device for a false twisting machine capable of preventing surging from occurring.

A still another object of the present invention is to provide a cooling device for a false twisting machine wherein cleaning can be easily done.

According to the present invention, a cooling device is provided, which is arranged between a heating device and a twisting device in a false twisting machine for cooling a yarn, said cooling device comprising:

a first yarn contacting member;

a second yarn contacting member spaced from the first yarn contacting member so that a passageway is formed between the first and second yarn contacting members, the yarn to be treated running along the passageway;

the arrangement of the first and second yarn contacting members being such that a contact of the yarn with a surface of at least one of the contacting member is occurred, and;

means for generating a flow of gas in the passageway in a direction transverse to the direction of the movement of the yarn.

According to this construction, cooling is done under an action of contacting the yarn with the cooling surface as well as an action of a fluid, thereby increasing the cooling capacity. Namely, a length of the cooling device can be reduced one half of that in the prior art, resulting in a reduction in a dragging force generated in the yarn, thereby reducing a tension in the yarn at the false twister, permitting a twist to be easily propagated along the length of the yarn. Thus, at an increased yarn processing speed, a desired quality of the bulky yarn is obtained, i.e., tenacity, elongation and crimping factor are maintained unchanged. Furthermore, during the operation, the yarn is always contacted with the contacting surfaces of at least one of the contacting members. Thus, surging is prevented even under a low tension state of the yarn. Furthermore, due to the reduction of the length of the cooling device, a compact structure of the false twisting machine is realized, which allows work as well as maintenance to be done easily.

Advantageously, the cooling device further comprises means for obtaining a relative movement of said first and second yarn contacting members between an operating position where the first and second members are faced with each other for creating said passageway and a rest position where the first and second members are spaced from each other. Due to this arrangement, a cleaning of the contacting members at the rest position can be done very easily.

Advantageously, the cooling device comprises means for variably adjusting the spacing between the first and second members during the operating condition. As a result, an adjustment of the desired spacing between the contacting surface can be done in a very effective way without requiring a high precision of the parts. Furthermore, a desired uniform sucking speed is obtained in the yarn treating passageways.

Advantageously, at least one of said first and second yarn contacting members is formed with fins which contact with the flow of the gas. As a result of this structure, heat emission can be done at a high efficiency.

Advantageously, the cooling device further comprises means arranged at an end of said passageway adjacent the heating device for sucking smoke generated from the yarn due to a heating operation in the heating device and means for controlling the degree of sucking the smoke.

BRIEF EXPLANATION OF ATTACHED DRAWINGS

DESCRIPTION OF PREFERRED EMBODIMENTS

Figure 1:
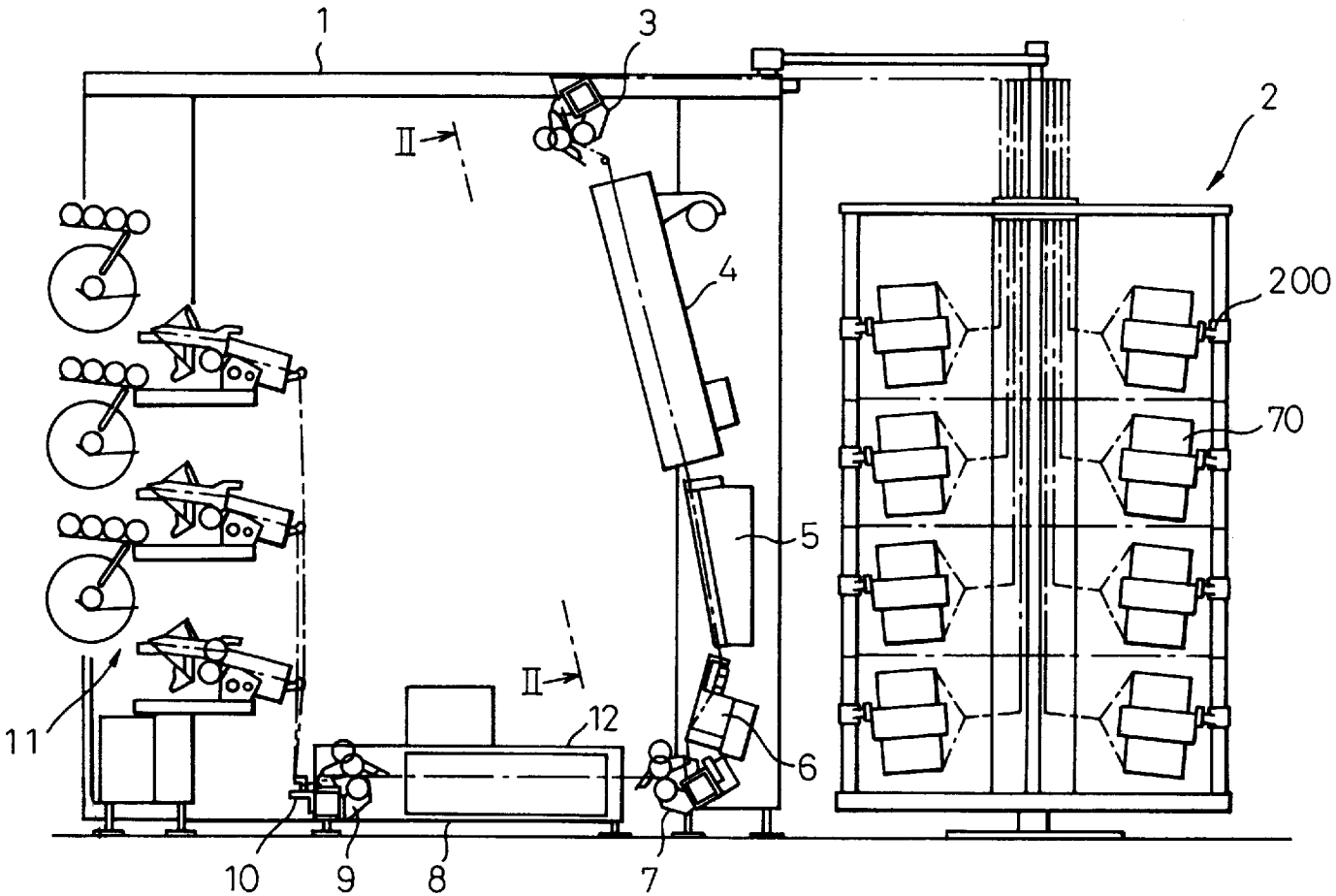
FIG. 1 is a schematic view of a false twisting machine provided with a cooling device according to present invention.
Figure 2:
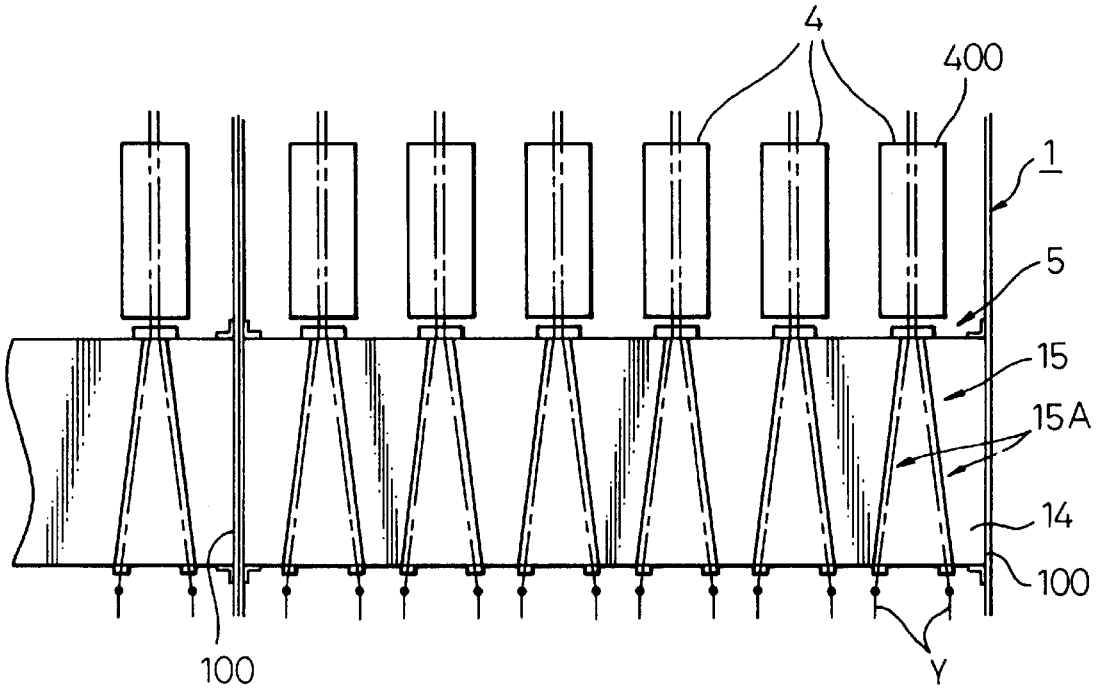
FIG. 2 is a view taken along a line II—II in FIG. 1.

In FIGS. 1 and 2, which illustrate a false twisting machine having a cooling apparatus according to the present invention, reference 1 denotes a machine frame, 2 a creel stand, 3 a first yarn feeder, 4 a first heater, 5 a yarn cooler, 6 a false twisting device, 7 a second yarn feeder, 8 a second heater, 9 a third yarn feeder, 10 a device for imparting a spinning oil, and 11 a yarn taking up device. In a well known manner, the creel stand 2 is provided with a plurality of rods 200 for supporting yarn packages 70. On the inner side of the creel stand 2, from the top to the bottom, the first yarn feeder 3, the first heater 4, the cooler 5, the false twisting device 6 and the second yarn feeder 7 are fixedly arranged to the machine frame 1. On the bottom of the machine frame 1, the second heater 8, the third yarn feeder 9 and the oil feeder 10 are arranged, while an operating platform 12 is arranged above the units 8 to 10. The yarn taking up device 11 is arranged on one side of the operating platform 12 opposite the creel stand 2. In a well known manner, a plurality of sets of the above mentioned units 3 to 11 are provided. Namely, the frame 1 is comprised of a plurality of columns 100, while 12 yarns are treated in a span between the columns 100, which are located adjacent to each other (see FIG. 2). As shown in FIG. 2, the heating device 4 is constructed by heating sections 400, each of which is for treating two yarns. The cooling device 5 is constructed of cooling sections 15, each of which is constructed by a paired cooling passageways 15A, which are for treatment of the two yarns from the corresponding heating sections 400. In other words, in each span, 6 heating sections 400 and 6 cooling sections 15 are arranged. The cooling device 5 is further provided with sucking means constructed as ducts 14, each of which is connected to the cooling parts 15. These ducts 14 are in series connection and are connected to a fan (not shown), which is connected to a rotating motor (not shown). An inverter (not shown) for controlling a rotating speed of the fan is provided for controlling sucking of the gas from the cooling parts 15 to the ducts 14.

Figure 3:
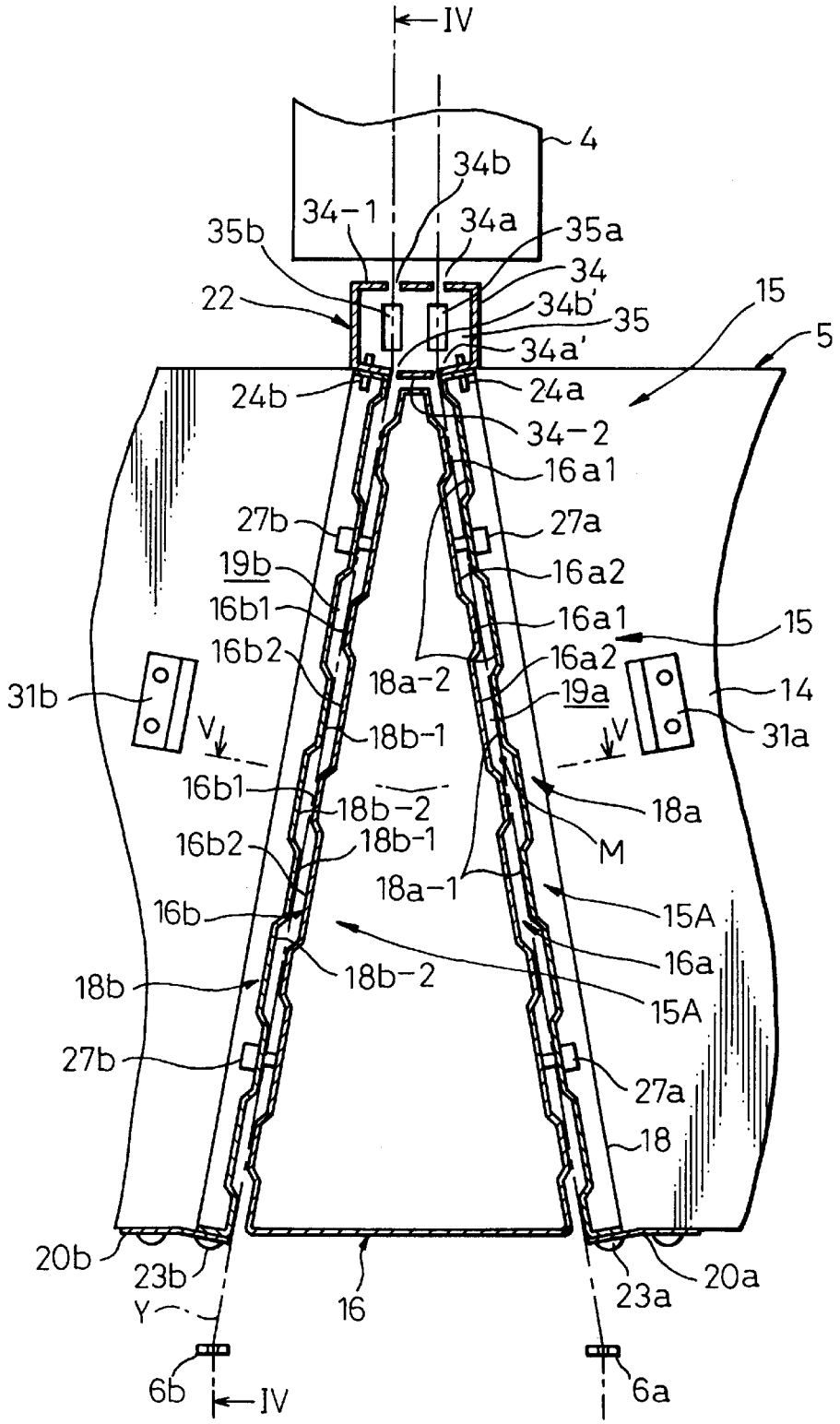
FIG. 3 is a front view of a cooling device according to present invention.
Figure 4:
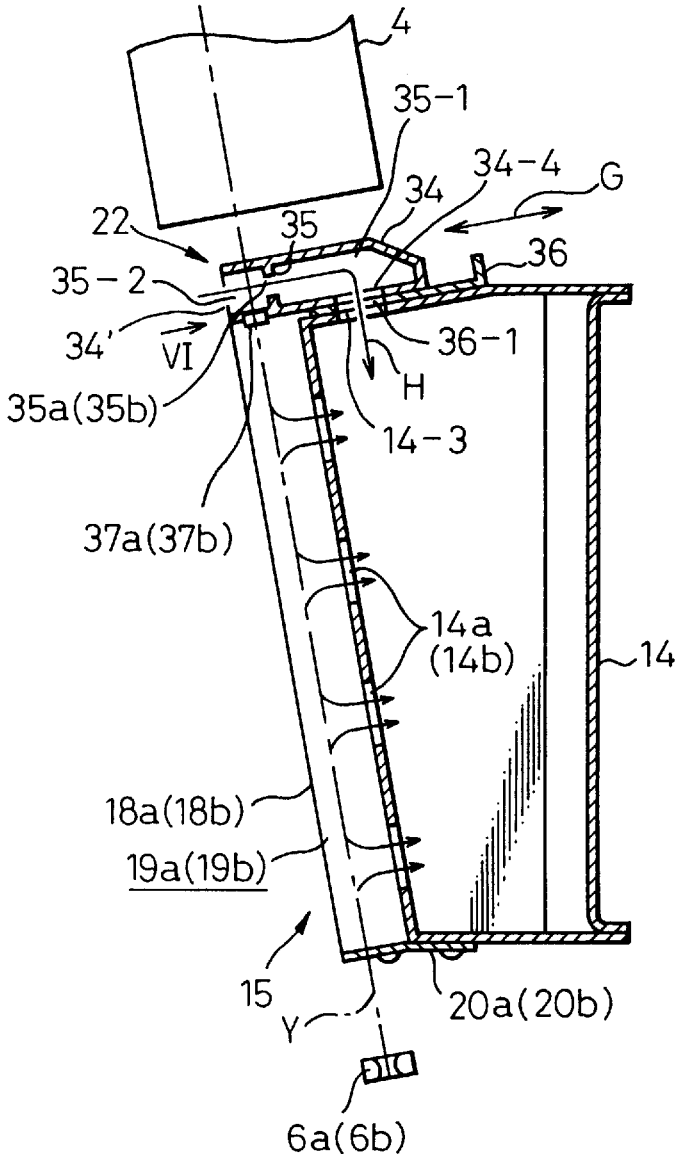
FIG. 4 is a view taken along line IV—IV in FIG. 3.
Figure 5:
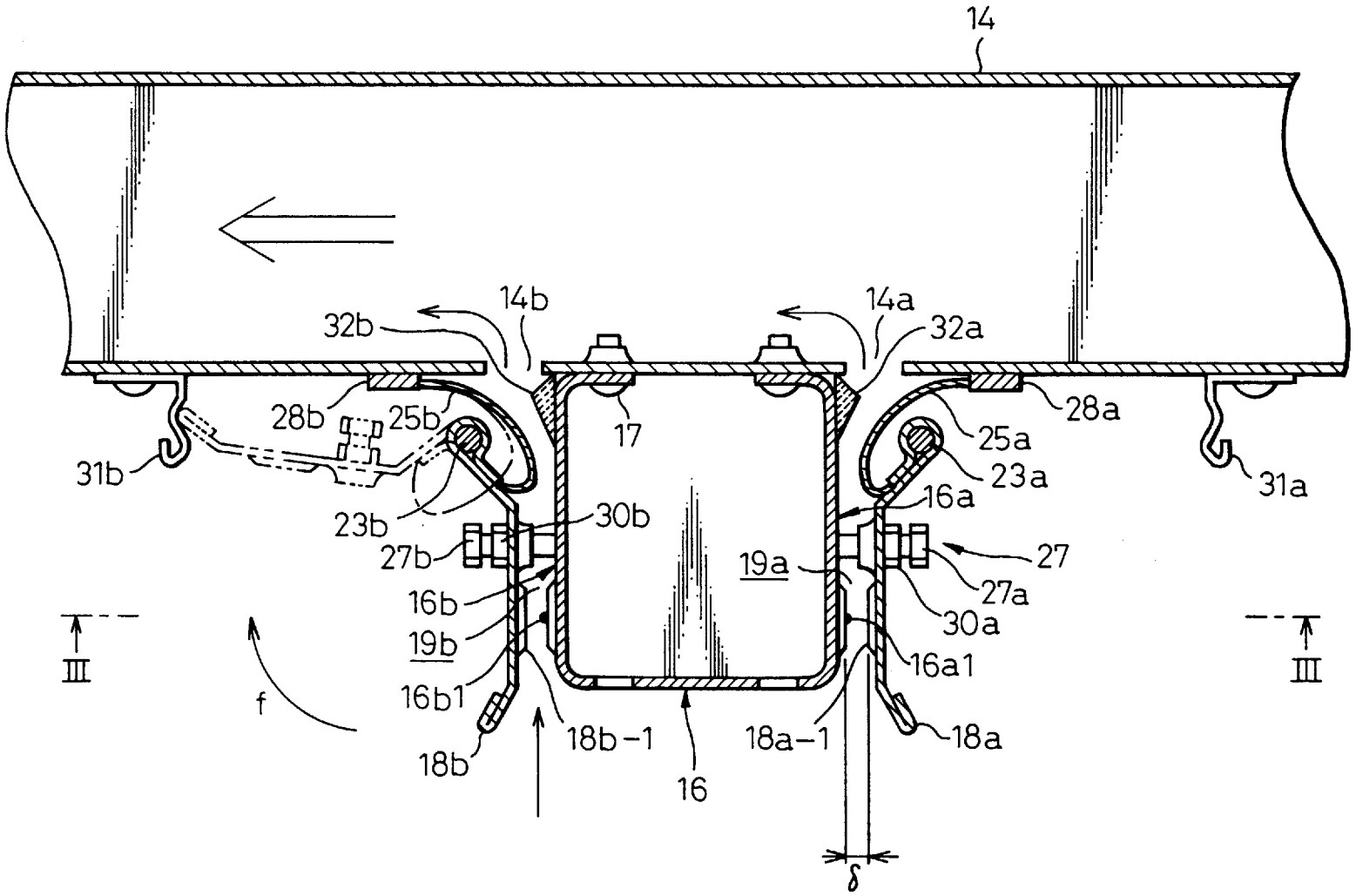
FIG. 5 is a view taken along line V—V in FIG. 3.

The duct 14 has pairs of vertical rows of elongated slits 14*a* and 14*b*, as shown in FIGS. 4 and 5. The cooling part 15 is provided with a fixed wall member 16 having a closed profile as shown in FIG. 5 and is fixedly connected to the front wall of the duct 14 by means of bolt 17 in such a manner that the member 16 extends along the slit 14*a* and 14*b*, while being located between the slit 14*a* and 14*b*. Due to the downwardly widened structure of the member 16 as shown in FIG. 3, the distance between the side surfaces 16*a* and 16*b* is widened at the bottom portion over the top portion. However, a construction may be employed where the distance between the side surfaces 16*a* and 16*b* are vertically identical. The cooling part 15 is further provided with a pair of movable wall members 18*a* and 18*b* which are arranged on the sides of the fixed wall member 16. Thus, yarn treating passageways 19*a* and 19*b* are formed between the side member 16*a* and 16*b* of the fixed wall member 16 and the movable wall members 18*a* and 18*b*, respectively in such a manner that the passageways 19*a* and 19*b* are, on one hand, opened outwardly and are opened to the slits 14*a* and 14*b*, respectively, on the other hand. The movable wall members 18*a* and 18*b* are, at their bottom ends, rotatably connected to brackets 20*a* and 20*b*, respectively, by pins 23*a* and 23*b*, respectively, and are, at their top ends, rotatably connected by pins 24*a* and 24*b* to a smoke removing unit 22, which is located above the duct 14. As a result, a door-like swing movement of the movable wall members 18*a* and 18*b* as shown by an arrow f is realized about axes of the pins 23*a* and 23*b* and 24*a* and 24*b*, which extend substantially vertically.

As a modified structure for obtaining a swing movement of the movable wall members 18*a* and 18*b*, brackets are connected to the duct 14, to which brackets the wall members 18*a* and 18*b* are rotatably connected.

In the above structure, the ducts 14 may preferably have a different cross sectional area along the length in such a manner that further away from the fan, the smaller the cross sectional area of the ducts 14 is, thereby keeping a constant speed of the air flow sucked by the slits 14*a* and 14*b*. More advantageously, a flow control orifice is provided for each of ducts 14 for respective spans.

In FIG. 5, on the side surfaces 16*a* and 16*b* of the fixed wall member 16, yarn contacting portions 16*a*1 and 16*b*1, as spaced projections along direction of the movement of the yarn Y, are formed. In other words, between the contacting portions 16*a*1, which are adjacent with each other, recessed portions 16*a*2 are formed, while, between the contacting portions 16*b*1, recessed portion 16*b*2 are formed. Similarly, the movable wall members 18*a* and 18*b* are formed with yarn contacting portions 18*a*-1 and 18*b*-1 as spaced projections along the direction of the movement of the yarn Y. Thus, between the projected portions 18*a*-1, which are adjacent with each other, recessed portions 18*a*-2 are formed, while, between the projected portions 18*b*-1, recessed portion 18*b*-2 are formed.

In FIG. 3, the arrangement between the projected porions and the recessed portions is such that, in the recessed portions 16*a*2 of the side surface 16*a* of the fixed member 16, the yarn contacting portions 18*a*-1 of the movable member 18*a* are located, while, in the recessed portions 18*a*-2 of the movable member 18*a*, the yarn contacting portions 16*a*1 of the side surface 16*a* of the fixed member 16 are located. As a result of this structure, the yarn Y moves in the right yarn treating passageway 19*a* while contacting the portions 16*a*1 and 18*a*-1 alternately or moving along the tangential direction of the portions 16*a*1 and 18*a*-1. Similarly, in the recessed portions 16*b*2 of the side surface 16*b* of the fixed member 16, the yarn contacting portions 18*b*-1 of the movable member 18*b* are located, while, in the recessed portions 18*b*-2 of the movable member 18*b*, the yarn contacting portions 16*b*1 of the side surface 16*b* of the fixed member 16 are located. As a result of this structure, the yarn Y moves in the yarn treating passageway 19*b* while contacting the portions 16*b*1 and 18*b*-1 alternately or moving along the tangential direction of the portions 16*b*1 and 18*b*-1.

In the above arrangement, the distance between the fixed wall members 16 and the movable wall members 18*a* and 18*a* is such that, when the yarn Y is stopped, any contact of the yarn Y with the contacting portions 16*a*1 and 18*a*-1 and 16*b*1 and 18*b*-1 does not occur and that, when the yarn Y is running, the contact of the yarn with the contacting portions does also not occur so long as the vibration of the yarn is small while a large vibration causes the yarn to be contacted with the contacting portions, thereby preventing a large vibration from being generated in the yarn. As a result of this arrangement, portions of the yarns, which correspond to tail tied portions between yarn packages, can be passed without being blocked.

In the above structure, the total length L of the yarn contacting portions 16*a*1 and 18*a*-1 or 16*b*1 and 18*b*-1 along the direction of the movement of the yarn Y in the yarn treating passageway 19*a* or 19*b* is desirably such that the total length of the yarn not contacting with the yarn contacting portions is smaller than 50 mm, and more preferably in a range between 10 to 30 mm and a ratio of the length of the contact of the yarn with the yarn contacting portions is of about 50%. Furthermore, the width W of the yarn contacting portions is preferably in a range between 10 to 50 mm. Finally, the distance δ between the yarn contacting portions, which are adjacent to each other, is, preferably, a thickness of the yarn multiplied by a value in a range between 2 to 10. In the above structure, in place of forming the fixed wall member as a single block, two separate fixed wall members for constructing the yarn contacting wall members 16*a* and 16*b* are provided. Furthermore, the yarn contacting portions are constructed from a stainless steel which is subjected to a surface treatment such as a nitride treatment or a mirror like buff treatment or hardened crome plating or frame plating for providing a surface of a Vickers hardness of a value of 700 or more and for providing an increased heat transfer capacity.

According to the present invention, spring plates 25*a* and 25*b* of a thickness of a value in a range 0.1 to 0.5 mm are provided, which are, at their inner ends attached to the outer wall of the duct 14 by means of suitable means such as elastic member 28*a* and 28*b*, which are made of a resilient magnetic member such as a rubber magnet member. This structure is desirable in that a reduction of the gap is possible. In place of the use of the magnetic attaching members 28*a* and 28*b*, the spring plates 25*a* and 25*b* are mechanically connected to the duct 14. The spring members 28*a* and 28*b* are, at their outer ends, fixedly connected to the movable wall members 18*a* and 18*b* at locations adjacent to the inner side edges. As a result, a spring force is generated by the spring members 28*a* and 28*b*, so that the movable members 18*a* and 18*b* are rotated to positions as shown by the solid lines. Screws 27*a* constructing adjustable spacers are arranged at top and bottom of the plates 18*a* and 18*b*, respectively. The screw members 27*a* and 27*b* contact, at the inner ends, with the opposed side surfaces of the fixed wall member 16, thereby obtaining a desired value of the distance δ between the faced pairs of the yarn contacting portions 16*a*1 and 18*a*-1 and 16*b*1 and 18*b*-1, as shown in FIG. 5. Namely, the screw members 27*a* and 27*b* are adjusted by manually rotating the members 27*a* and 27*b*, thereby adjusting the projected length of the screws, i.e., the value of the distance δ between the faced yarn contacting portions. In order to fixedly connect the screw members 27*a* and 27*b* to the movable wall members 18*a* and 18*b*, respectively, locking nuts 30*a* and 30*b* are connected to the members 27*a* and 27*b*. As an alternative, pins are connected to the stationary wall member 16 or the movable wall members 18*a* and 18*b*.

As shown in FIG. 5, the movable wall members 18*a* and 18*b* can be, against the force of the springs 25*a* and 25*b*, rotated about the pins 23*a* and 23*b* and 24*a* and 24*a*, from the operating positions as shown by the solid lines, to respective rest positions as shown by phantom lines. In this rest positions, the movable wall members 18*a* and 18*b* are under a snap engagement with holding members 31*a* and 31*b*, respectively fixed on an outer wall of the duct 14.

As shown in FIG. 5, at locations on the surfaces of the fixed wall member 16 adjacent the elongated slits 14*a* and 14*b* on the outer wall of the duct 14, heat emission fins 32*a* and 32*b* are arranged. These fins 32*a* and 32*b* can be made of the same material as that for the stationary wall member 16 and welded to the member 16. As an alternative, the fins 32*a* and 32*b* are made from the same material as that of the member 16 or made from material of an increased heat conductivity such as an aluminum alloy or cooper alloy, which are connected to the member 16 by means of rivets or silver brazing. The fins 32*a* and 32*b* may be connected to the movable wall members 18*a* and 18*b*. Furthermore, the fins 32*a* and 32*b* may also be connected to both of the stationary and movable wall members 16 and 18*a* and 18*b*. These fins 32*a* and 32*b* function to emit heat and also function to prevent wasted filaments of an increased dimension from being introduced into the duct 14.

The smoke removing system 22 is, as shown in FIG. 4, constructed by a box 34 connected to the top part of the duct 14 having an opening 34' of substantially rectangular shape, which is opened transversely to the direction of the movement of the yarn Y, an inner partition wall 35 in a location in the box 34 adjacent the yarn Y, so that the space inside the box 34 is divided to an inner chamber 35-1 and an outer chamber 35-2, and an adjusting plate 36 for controlling an amount of the air flow which is arranged between the duct 14 and the box 34, so that the plate 36 is slidably movable as shown by an arrow G in FIG. 4. Namely, the bottom wall of the box 34 and the top wall of the duct 14 are formed with aligned holes 34-4 and 14-3, between which the adjusting plate 36 is formed with an adjusting hole 36-1. As a result, the slide movement of the plate 36 causes the degree of the opening of the adjusting hole 36-1 to be varied, thereby causing an amount of the gas flow to be varied in accordance with the position of the plate 36.

Figure 6:
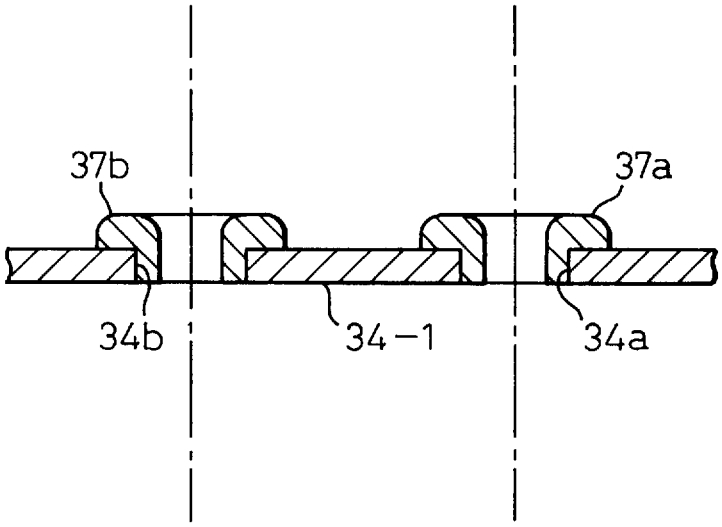
FIG. 6 is a view taken along a line VI in FIG. 4.

As shown in FIG. 3, the box 34 includes a top and bottom wall 34-1 and 34-2, which defines the top and bottom portions of the opening 34' of the box 34. The top wall 34-1 forms slits 34*a* and 34*b* which are spaced horizontally, while the bottom wall 34-2 forms slits 34*a*' and 34*b*'. The slit 34*a* on the top wall 34-1 and the slit 34*a*' on the bottom wall are vertically aligned, while the slit 34*b* on the top wall 34-1 and the slit 34*b*', on the bottom wall are vertically aligned. These slits 34*a* and 34*b* and 34*a*' and 34*b*', extend horizontally and are opened outwardly, which makes it easy for the yarns Y to be introduced into the slits. As shown in FIG. 6, in the slits 34*a* and 34*b* on the top wall 34-1, guide members 37*a* and 37*b* made a plastic material of a reduced friction are fitted. Similarly, guide members are also fitted to the slits 34*a*' and 34*b*' on the bottom wall 34-2 of the box 34.

As shown in FIG. 3, in the vertical partition wall 35 in the box 34, horizontally spaced elongated slits 35*a* and 35*b* are formed so that the slits 35*a* and 35*b* opened to and extending along the yarns Y, respectively. As shown in FIG. 4, these slits 35*a* and 35*b* are for communicating the chambers 35-1 and 35-2 with each other, so that the smoke generated from the yarns in the chamber 35-2 is, under the effect of a vacuum, sucked into the chamber 35-1 and then into the duct 14 via the control valve 35 (openings 34-4, 36-1 and 14-3) as shown by an arrow H. Thus, a lamp black as generated from spinning oil applied to the yarns Y when the latter are subjected to the heating at the heater 4 is removed at the exhaust device 22, i.e., prevented from being introduced into the cooling device 5.

In the operation of present invention, the yarns Y are moved along straight lines which connects the guides 37*a* and 37*b* in the exhaust device 33 with guides 6*a* and 6*b* (FIGS. 3 and 4) of the false twisting devices 6, while the sucking fan (not shown) connected to the duct 14 is operated, so that a suction force is generated in the yarn treatment passageway 19*a* and 19*b* between the stationary and movable wall members 16 and 18*a* and 18*b* via the sucking holes 14*a* and 14*b*, respectively. As a result, the yarns Y are moved in the corresponding yarn treatment passageway 19*a* and 19*b*, while being curved slightly toward the duct 14 under the action of the sucking force, while being slightly vibrated transversely. Such a transverse vibration assists that depositions on the yarn contacting portions 16*a*1 and 16*b*1 and 18*a*-1 and 18*b*-1 of a reduced adhesive force are separated therefrom and are sucked to the duct 14, i.e., a self cleaning action of the yarn contacting portions is obtained.

Figure 7:
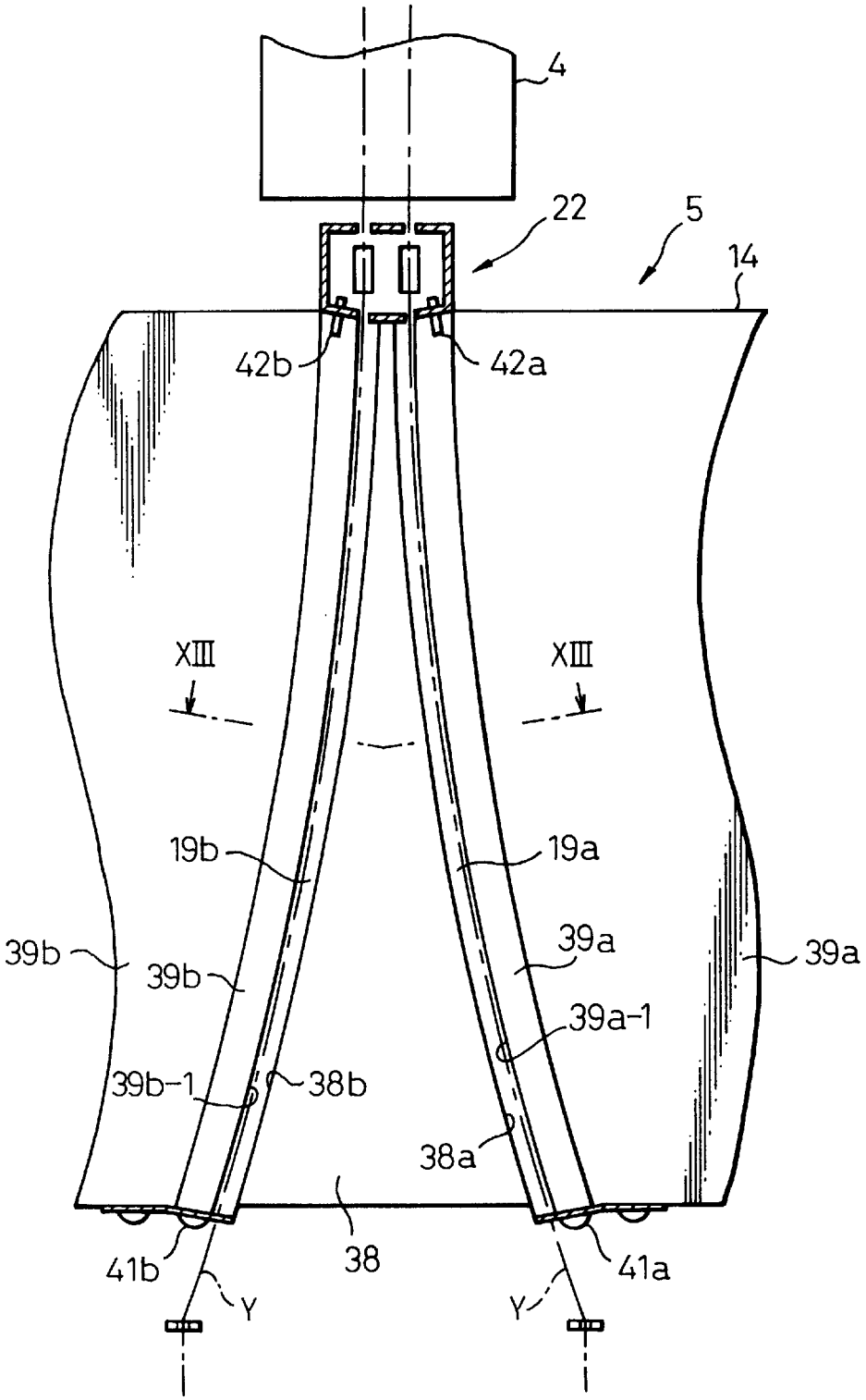
FIG. 7 is a front view of a cooling device in a second embodiment of the present invention.
Figure 8:
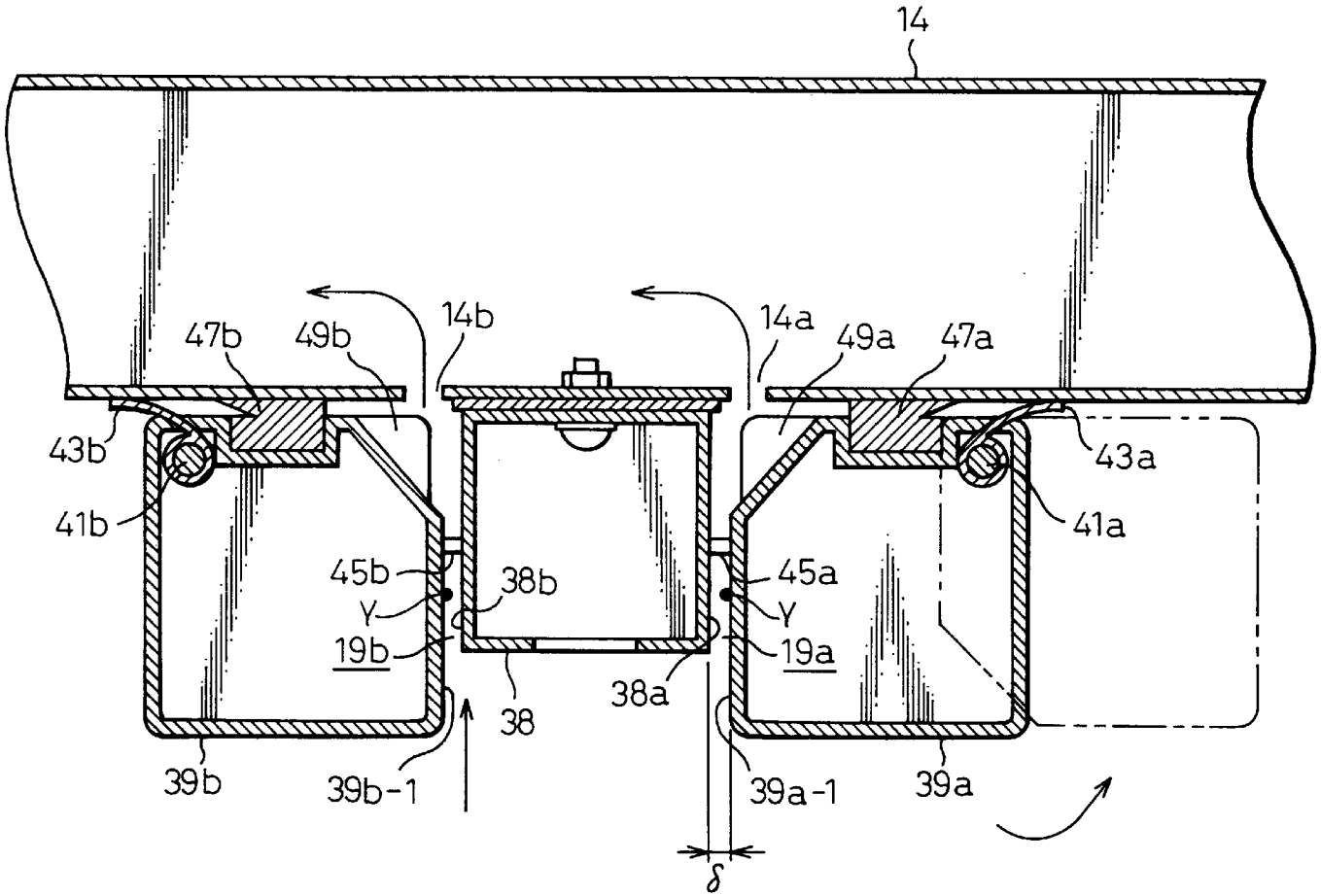
FIG. 8 is a cross sectional view taken along line XIII—XIII in FIG. 7.

In FIGS. 7 and 8, a modified structure of a cooling device according to present invention is shown, which include a fixed wall member 38 of a cross sectional shape of a rectangular shape and movable wall members 39*a* and 39*b* also of a rectangular cross sectional shape. The fixed wall member 38 has side surfaces 38*a* and 38*b*, which face side walls 39*a*-1 and 39*b*-1, respectively, of the movable wall members 39*a* and 39*b*. The movable members 39*a* and 39*b* are rotatable about pins 41*a* and 41*b* at bottom ends and pins 42*a* and 42*b* at top ends. Springs 43*a* and 43*b* urge the movable members 39*a* and 39*b* to rotate to positions as shown by solid lines, where pins 45*a* and 45*b* are in contact with the fixed wall member 38, so that outwardly opened yarn treating passageways 19*a* and 19*b*, to which the duct 14 is opened via slits 14*a* and 14*b*, are formed between the faced surface of the wall members 38 and 39*a* and 39*b*. Seal members 47*a* and 47*b*, which are produced of a soft resilient material such as synthetic rubber or synthetic resin are in sealed contact with the front wall of the duct 14. The movable wall members 39*a* and 39*b* are rotated to rest position as shown by dotted lines against the force of springs 43*a* and 43*b*.

As shown in FIG. 7, faced pairs of the yarn contacting surfaces 39*a* and 39*a*-1 are curved, so that the yarn treating passageways 19*a* and 19*b* are curved, while the space between the passageways 19*a* and 19*b* are widened at their bottom. It is desirable that the yarn contacting surfaces 39*a*-1 and 39*b*-1 are flattened so that a desired contact of yarns Y with the contacting surfaces is obtained along the entire length thereof.

Finally, as shown in FIG. 8, heat emission fins 49*a* and 49*b* are formed at the side surfaces 39*a*-1 and 39*b*-1 of the movable wall members 39*a* and 39*b*, respectively.

EXAMPLE 1

By using the draw-false twisting machine according to the present invention, a draw-false twisting of yarns was done under the following false twisting condition.

Processing conditions:

Yarns to be treated; POY polyester yarn of thickness of 140 denier and of 36 filaments.

First stage heating device (4); an effective length of 0.78 meter and a yarn temperature of 215° C.

False twister (6); an outer contact three axis type having a top and bottom ceramic disks between which seven rubber disk are arranged; the untwisting tension ratio $T_1/T_2$ of about 1.2; and a number of twist at the location above the cooling device of 3,300 per meter.

Cooling device (5); an effective length of 0.6 m and an average sucking speed at the yarn passageway of about 5 m/s, measured by small size "Pitot tube" at point M in FIG. 3 without the presence of any yarn.

Yarn treatment speed; 800 m/min to 1400 m/min.

Figure 10:
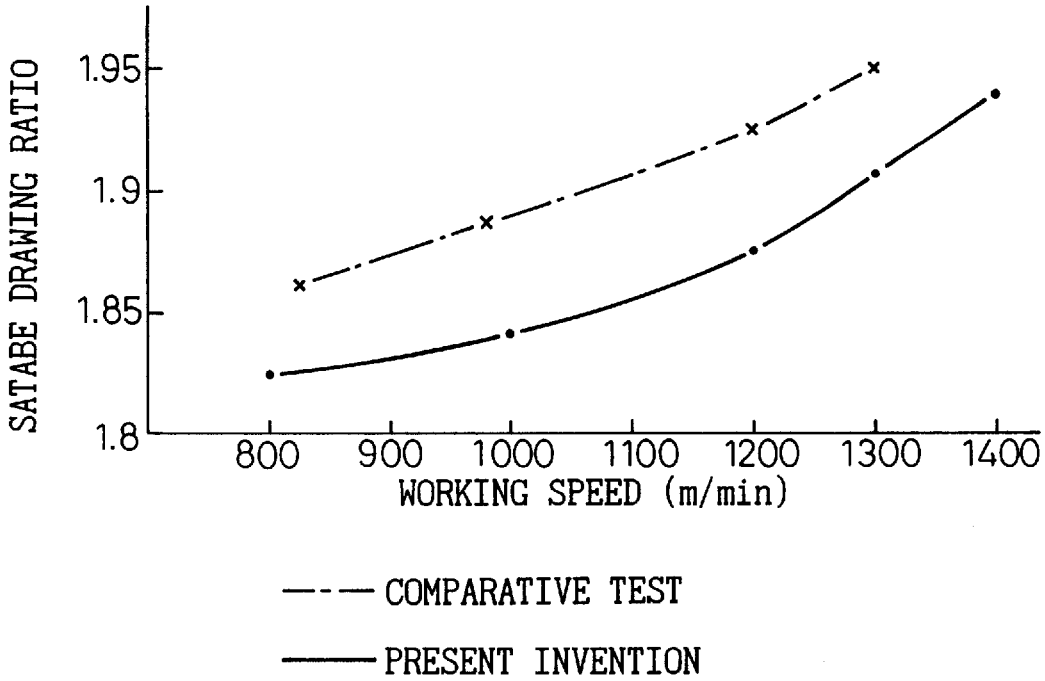
FIG. 10 is relationships between a working speed and a stable drawing ratio.

Drawing speed; an upper limit speed, which generates a variation in an untwisting tension and a surging in the yarn passageway in the cooling device or the first heating device, minus a predetermined allowance value, which was empirically determined as shown in FIG. 10.

Figure 11:
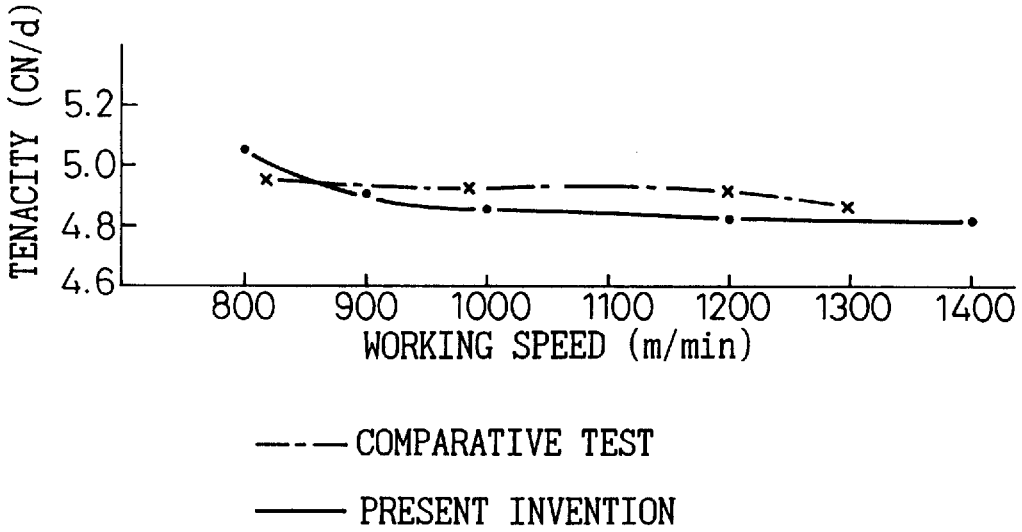
FIG. 11 is relationship between a working speed and a tenacity.
Figure 12:
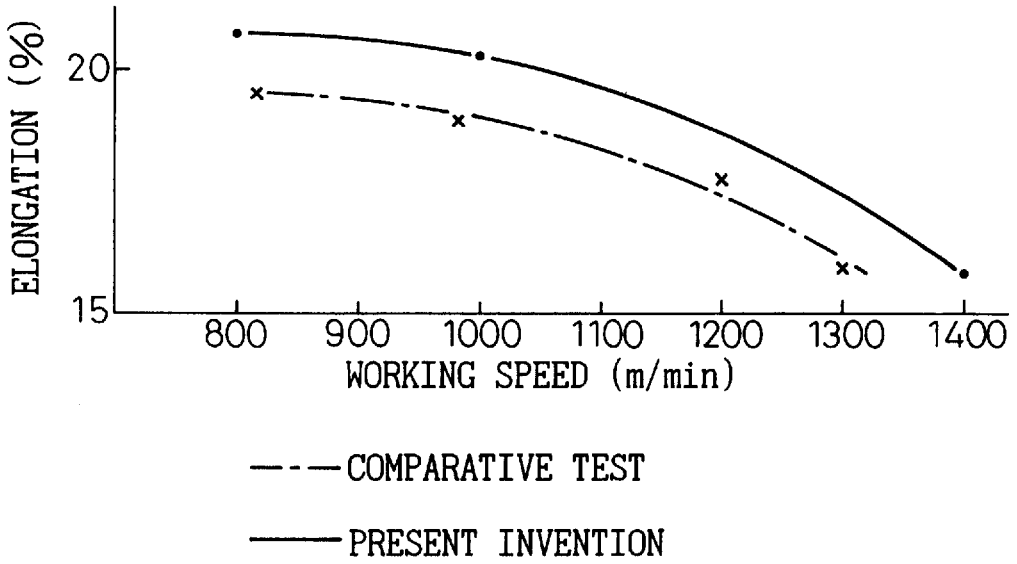
FIG. 12 is relationship between a working speed and elongation.
Figure 13:
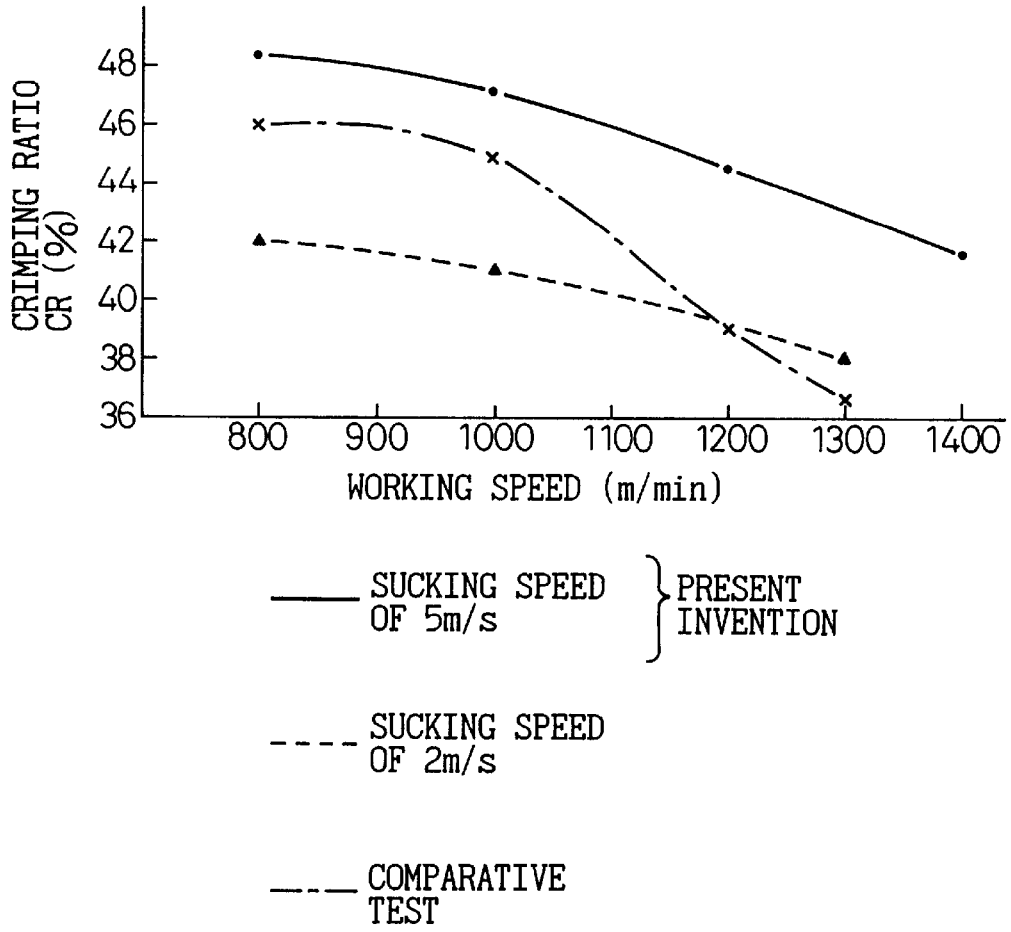
FIG. 13 is relationship between a working speed and crimping ratio.

The result of measurements of the yarns after the treatment are shown in FIGS. 11, 12 and 13 as to the yarn tenacity in CN/d, the yarn elongation in % and the degree of crimping in CR, respectively. The measurement of the crimping ratio is as follows.

Ten hanks of yarn are prepared while a yarn tension of 0.05 CN/d is loaded.

Then, the sample is immersed to a water of 90° C. for 20 minutes.

Then, the sample is kept in a room temperature for 12 hours.

Then, the sample is immersed in the water of a temperature of 20° C. while a yarn tension of 0.04 CN/d is applied.

Then, a yarn tension of 0.2 CN/d is added in the water and, after an elapse of 2 minutes, a length L1 of of a hank of the sample is measured.

Then, in the water, the additional load of 0.02 CN/d is eliminated, so that only the tension of 0.04 is applied to the sample, and, after an elapse of 3 minutes, a length L2 of a hank of the sample is measured.

The crimping ratio CR (%) is calculated by the following equation, $$CR = \frac{L1 - L2}{L1} \times 100(\%).$$

In FIG. 13, a sucking speed of 2 m/s as shown by a dotted line causes the crimp ratio to be reduced. Contrary to this, the increase of the air sucking speed to a value of 5 meter/sec causes the crimping ratio to be highly increased. However, an increase in the air sucking speed finally causes that, on one hand, an increase is saturated in the value of the crimping ratio CR and a loss of an energy for operating a sucking fan (not shown) is increased, on the other hand. In other words, it is desirable that a setting of the air sucking speed is done in accordance with the various factors in a false twisting process, such as a thickness of the yarn and a processing speed. In view of this, it is desirable that an inverter is provided for controlling a rotational speed of the electric motor for rotating the sucking fan in the duct 14 so that a desired condition is obtained. As an alternative, a device for measuring a sucking speed or a static pressure is provided in a selected yarn treatment zone, and a feed back control of a sucking speed to a predetermined value is done by comparing the detected sucking speed with the preset value.

It should be noted, the value of the air flow speed is obtained by measuring the pressure at some locations by using a Pitot tube and the measured values are averaged.

Comparative Test

Figure 9:
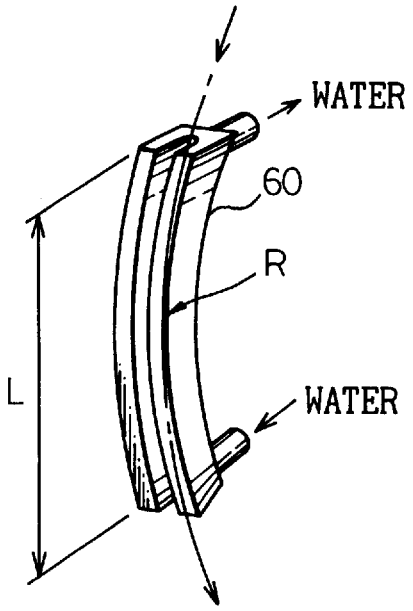
Fig.9 PRIOR ART
FIG. 9 is a perspective view of a cooling device in a prior art.

FIG. 9 shows a curved type cooling device 60 for a comparative test, which is provided with a water jacket 60 therein for a recirculation of a cooling medium, where the heater is curved and is of a length L of 1.08 m and of a curvature of 10 m at a yarn contact surface. False twisting conditions were the same as that in the example 1 except for the drawing ratio as shown in FIG. 10. In FIGS. 11, 12 and 13, the tenacity, the elongation and the crimping ratio in the comparative test are shown.

As will be seen from comparison of the results, the tenacity of the yarn in the present invention is slightly reduced over that in the prior art as shown in FIG. 11. However, the strength larger than 4.6 CN/d which is generally required can be obtained. Furthermore, as to an elongation an increase is obtained in the present invention over that in the prior art. Furthermore, will be seen from FIG. 13, the prior art makes it impossible to obtain a value of the crimp ratio larger than 40%, which is usually required, when the yarn treating speed is higher than 1,200 m/min. Contrary to this, in the present invention, a value of the crimp ration of 42% is obtained under the yarn treating speed of 1,400 m/min when the air sucking speed is of 5 m/sec. In other words, an increased degree of crimping can be obtained according to the present invention, due to an increased cooling effect.

Furthermore, as far as the drawing ratio is concerned as shown in FIG. 10, a setting of a reduced value of drawing ratio is possible according to present invention over the prior art. Thus, a reduced yarn tension during the operation is sufficient for preventing a surging phenomenon from being occurred.

EXAMPLE 2

A test is done in order to obtain a relationship between a sucking speed and the yarn cooling capacity for a yarn thicker than that at the example 1 by using the same false twisting machine under the following false twisting condition.

Processing conditions:

Yarns to be treated; POY polyester yarn of thickness of 270 denier and of 48 filaments.

First stage heating device; an effective length of 0.78 meter and a yarn temperature at the outlet of 215° C.

False twister; an outer contact three axis type having top and bottom ceramic disks between which seven rubber disk are arranged; the untwisting tension ratio $T_1/T_2$ of about 1.2; and a number of twist at the location above the cooling device of 2,300 per meter.

Cooling device; an effective length of 0.6 m and an average sucking speed at the yarn passageway of about 0 m/s, 10 m/s and 27 m/s. Measuring method is the same as that in the example 1.

Yarn treatment speed; 800 m/min to 1200 m/min.

Figure 14:
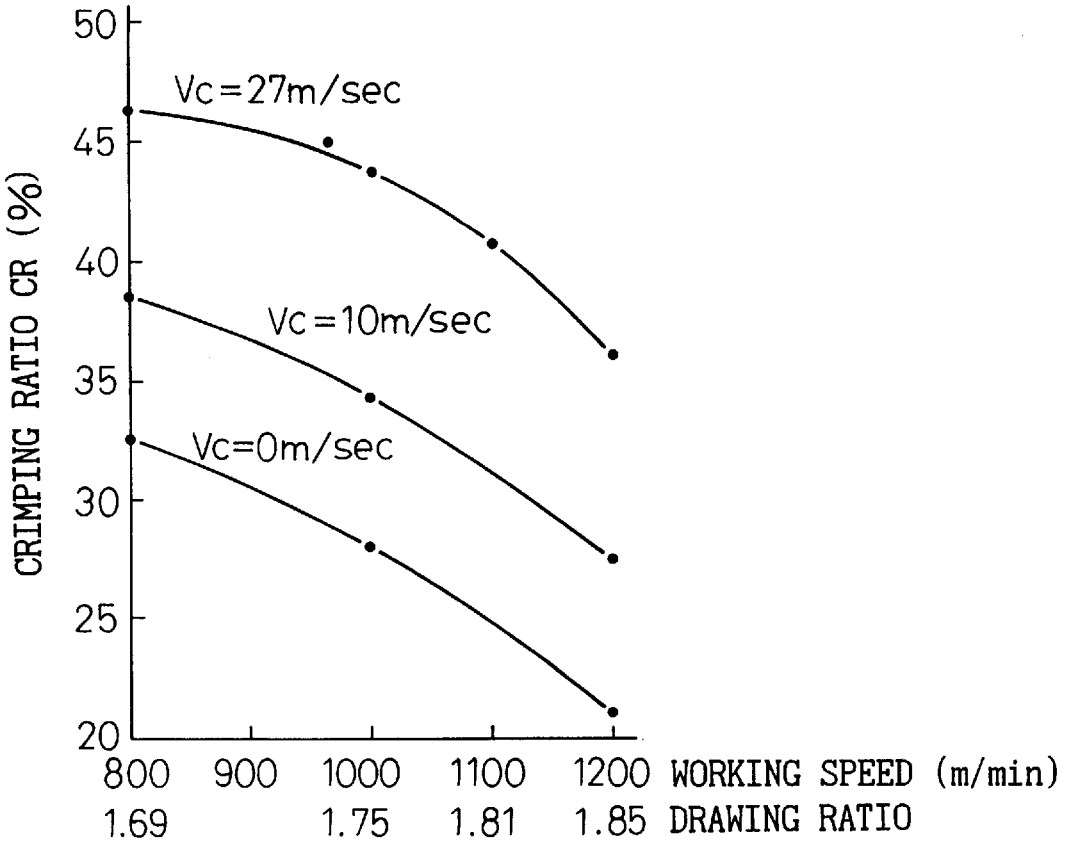
FIG. 14 is relationship between a working speed and crimping ratio.

Drawing speed; an upper limit speed, which generates a variation in an untwisting tension and a surging in the yarn passageway in the cooling device or the first heating device, minus a predetermined allowance value, which is suitably determined as shown in the bottom of FIG. 14.

A result of the measurement of crimping ratio CR in % for the bulky yarn after subjected to a draw-twisting is shown in FIG. 14 with respect to various values of gas flow speed Vc. As will be clear from FIG. 14, in order to obtain the value of crimping ratio CR (%) larger than 40 (%), the flow speed at the yarn treating part larger than 27 m/s is needed when the yarn speed is 1100 m/min. Furthermore, it is also seen that no flow of the gas, i.e., the value of the flow speed of 0 m/min can give a crimping ratio of only 32.5% even at the processing speed of 800 m/min. This means that an increased length is needed when the cooling device is used wherein a cooling by a contact with the cooling member is only done.

We claim:

1. A cooling device arranged between a heating device and a twisting device in a false twisting machine for cooling a false twisted yarn, comprising:

a first yarn contacting member;

a second yarn contacting member spaced from the first yarn contacting member to form a passageway between the first and second yarn contacting members, the yarn to be cooled moving along the passageway;

the arrangement of the first and second yarn contacting members being such that the yarn to be cooled must make contact with a surface of at least one of the contacting members; and means for generating a flow of gas in the passageway in a direction transverse to the direction of the movement of the yarn, the flow of gas cooling the yarn moving along the passageway.

2. A cooling device according to claim 1, wherein said surface contacting with the yarn extends downwardly and is outwardly curved in the direction of yarn movement.

3. A cooling device according to claim 1, wherein said first and second yarn contacting members have plurality of contacting surfaces spaced along the direction of the movement of the yarn, so that the yarn contacts with the surfaces alternately between said first and second members.

4. A device according to claim 1, further comprising means for obtaining relative movement of said first and second yarn contacting members between an operating condition in which the first and second members face each other to form said passageway and a rest condition in which the first and second members are spaced from each other.

5. A device according to claim 4, further comprising means for variably adjusting the spacing between the first and second members during the operating condition.

6. A device according to claim 1, wherein at least one of said first and second yarn contacting members is formed with fins which contact with the flow of the gas, thereby promoting a heat emission.

7. A device according to claim 1, further comprising means arranged at an end of said passageway adjacent the heating device for withdrawing smoke generated by the yarn due to a heating operation in the heating device.

8. A device according to claim 7, further comprising means for controlling the degree of withdrawing the smoke.

9. A cooling device according to claim 1, wherein said gas flow generating means comprises a vacuum source, a duct connected to said vacuum source and opened laterally to said passageway, so that the flow of the gas for cooling the yarn is generated under the effect of vacuum at the vacuum source.

10. A cooling device according to claim 1, wherein the spacing between the yarn contacting members forming the passageway is related to the thickness of the yarn multiplied by a value in a range between 2 and 10.

* * * * *